US008136928B2

(12) United States Patent
Barbet

(10) Patent No.: US 8,136,928 B2
(45) Date of Patent: Mar. 20, 2012

(54) GENERATION OF DROPS FOR INKJET PRINTING

(75) Inventor: Bruno Barbet, Etoile sur Rhone (FR)

(73) Assignee: Markem-Imaje, Bourg-les-Valence (FR)

( * ) Notice: Subject to any disclaimer, the term of this patent is extended or adjusted under 35 U.S.C. 154(b) by 927 days.

(21) Appl. No.: 11/991,505

(22) PCT Filed: Sep. 11, 2006

(86) PCT No.: PCT/EP2006/066246

§ 371 (c)(1),
(2), (4) Date: Mar. 4, 2008

(87) PCT Pub. No.: WO2007/031498

PCT Pub. Date: Mar. 22, 2007

(65) Prior Publication Data

US 2009/0225112 A1 Sep. 10, 2009

Related U.S. Application Data

(60) Provisional application No. 60/738,122, filed on Nov. 18, 2005.

(30) Foreign Application Priority Data

Sep. 13, 2005 (FR) ..... 05 52758

(51) Int. Cl.
*B41J 2/02* (2006.01)

(52) U.S. Cl. ..... 347/75; 347/73; 347/74

(58) Field of Classification Search ..... None
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet et al. | |
| 4,220,928 | A | 9/1980 | Bloom et al. | |
| 4,346,387 | A | 8/1982 | Hertz | |
| 7,192,121 | B2 * | 3/2007 | Barbet et al. | 347/55 |
| 2003/0202054 | A1 | 10/2003 | Jeanmaire et al. | |
| 2003/0222950 | A1 | 12/2003 | Jeanmaire | |
| 2006/0262168 | A1 * | 11/2006 | Hawkins et al. | 347/74 |

FOREIGN PATENT DOCUMENTS

| | | |
|---|---|---|
| EP | 0 057 472 | 8/1982 |
| FR | 2 851 495 | 8/2004 |
| WO | WO 01/87616 | 11/2001 |

OTHER PUBLICATIONS

Lord W.S. Rayleigh: "On the Instability of Jets", Proceedings of the London Math. Soc., 1879; X : 4-13.
French Preliminary Search Report, FA 674198, FR 0552758, dated Jun. 1, 2006.
International Search Report, PCT/EP2006/066246, dated Jul. 11, 2006.

* cited by examiner

*Primary Examiner* — Matthew Luu
*Assistant Examiner* — Justin Seo
(74) *Attorney, Agent, or Firm* — Nixon Peabody LLP

(57) ABSTRACT

The generator according to the invention operates by strong stimulation in the form of pulses (τ) so as to generate drops, particularly for ink jet printing purposes. This choice enables breaking the jet (30) close to the ejection (16) and reduces the interference ratio. A generator with piezoelectric stimulation is particularly suitable.

13 Claims, 3 Drawing Sheets

GENERATION OF DROPS FOR INKJET PRINTING

CROSS REFERENCE TO RELATED APPLICATIONS OR PRIORITY CLAIM

This application is a national phase of International Application No. PCT/EP2006/066246 entitled "Generation Of Drops For Inkjet Printing", which was filed on Sep. 11, 2006, which was published in English, and which claims priority of the French Patent Application No. 05 52758 filed Sep. 13, 2005 and U.S. 60/738,122 Provisional Application filed Nov. 18, 2005.

TECHNICAL FIELD

The invention is in the field of liquid projection that is inherently different from atomisation techniques, and more particularly of controlled production of calibrated droplets, for example used for digital printing.

The invention relates particularly to a drop generator, for which the design and operating rules enable asynchronous production of liquid segments issuing from the forced breakage of a continuous jet of liquid. One preferred but non-exclusive application field is inkjet printing, this technique forming part of the continuous jet family, unlike drop-on-demand techniques.

BACKGROUND ART

Techniques related to inkjet printing form a rich domain in terms of drop generators dedicated to the controlled production of calibrated drops.

One possible technology is the continuous inkjet family that requires the pressurization of ink in an ink reservoir enclosed in the print head to form a continuous liquid jet: the ink reservoir comprises particularly a chamber that will contain ink to be stimulated, and a housing for a periodic ink stimulation device. Working from the inside outwards, the stimulation chamber comprises at least one ink passage to a calibrated nozzle drilled in a nozzle plate: pressurised ink passes through the nozzle, thus forming an ink jet.

The jet is broken into droplets using a stimulation device, the function of which is to modulate the radius of the jet; this forced fragmentation of the ink jet is usually induced at a point called the drop break up point by periodic vibrations of the stimulation device located in the ink reservoir on the upstream side of the nozzle. Jet radius modulation is amplified under the action of the surface tension of the liquid. This physical phenomenon, widely used in industrial continuous jet printers, was initially described and modelled by Lord W S Rayleigh (<<On the Instability of Jets>>, *Proceedings of the London Math*. Soc. 1879; X: 4-13).

A variety of means is then used to select drops that will be directed towards a substrate to be printed or towards a recuperation device commonly called a gutter. Therefore the same continuous jet is used for printing or for not printing the substrate in order to make the required patterns.

Various stimulation techniques can be envisaged. For example, Electro-Hydro-Dynamic (EHD) stimulation described in U.S. Pat. No. 4,220,928 (Crowley) consists of applying a potential difference between an electrically conducting jet at ground potential and an electrode at variable potential; the electrostatic pressure at the jet surface deforms the jet and the modulation of the radius is amplified by capillary instability leading to breaking up the jet.

Another approach is thermal stimulation, for example described in U.S. Pat. No. 4,638,328 (Drake): there is an imposed disturbance of the radius (or velocity) controlled by a thermo-resistive element close to the nozzle. Recent industrial developments have been derived from the silicon technology to manufacture this type of thermal drop generator (for example see Kodak's patent US 2003/0222950). However, the body of the drop generator is made of silicon, a material known for its mechanical weakness and very mediocre chemical resistance particularly in an alkaline medium, which limits the nature of projected liquids. Furthermore, actuators produce heat and consequently the accumulation of heat can increase the temperature of the head, thus modifying the properties of the ink and the associated physical parameters (for example the viscosity and therefore the jet velocity). It is difficult to control this temperature rise, knowing that the electrical energy dissipated in the heating resistances depends on the pattern to be printed. Finally, the action created on the jet takes place in a single direction, since the heating resistance is only capable of increasing the temperature of the ink, and it is not possible to create a disturbance on the jet inverse to that caused by heating. This point limits the control accuracy of the drop formation process.

These two techniques (EHD & thermal) have the advantage of being inherently non resonant; the addressed/stimulated portion of the jet is perfectly defined and enables asynchronous production of different size drops or segments. The disadvantage of these techniques is their low efficiency, which requires the use of very strong electrical control levels, or the use of complementary physical phenomena to efficiently break up the jet.

Apart from these approaches, generation of drops with a constant mass and velocity at a fixed frequency in a single-jet system, is also described in U.S. Pat. No. 3,596,275 (Sweet), wherein the stimulation device is a piezoelectric actuator. The main advantages of these types of actuators are excellent control over the drop size; the high operating frequency; and the efficiency and lack of a direct electrical contact between the fluid and the actuator.

Such continuous jet printers may comprise several print nozzles operating simultaneously and in parallel, in order to increase the print surface area and therefore the print speed. The piezoelectric stimulation technique is broadly used for the design of multijet generators, for example with an actuator for a jet array like the one described in U.S. Pat. No. 3,373,437 (Sweet), or an actuator for each jet as described in WO 01/87616 (Marconi).

SUMMARY OF THE INVENTION

One of the advantages of the invention is to overcome the above-mentioned disadvantages of existing generators and to form droplets by breaking up a continuous jet with another stimulation process. The device and the method according to the invention are particularly suitable for producing ink droplets and in a print head but other applications are possible.

The invention also relates to the use of a new method using short strong pulses to stimulate drop generators and particularly piezoelectric droplet generators used for inkjet printing. The short strong pulses are such that a jet can be broken up at a short and fixed distance but forming different size droplets thanks to the different lengths of the segments separated from the jet; this excitation is of the frequency modulation type and not of the "fixed frequency amplitude modulation" type.

According to one of its aspects, the invention relates to a projection method for a liquid, for example ink, in the form of drops wherein the liquid is pressurized in a chamber provided with nozzles so that it can exit from the chamber in the form of jets; the jet emitted through the nozzle has a specific radius and velocity. The method according to the invention also includes disturbance of the jet by a short duration stimulation pulse, particularly very much less than 3 times and preferably less than once or twice the ratio of the jet diameter to the velocity, such that the disturbance generates a break up in the jet. The jet length disturbed by the stimulation pulse is thus very much less than the optimum jet instability wavelength, namely about 9 times the radius of the jet, and the amplitude of the disturbance of the jet diameter will be greater than 20% of the diameter of the jet at the exit from the nozzle.

The disturbance signal may advantageously use a square shape pulse, and include a sequence of pulses spaced at modulated periods so as to form drops with different sizes. The method according to the invention may be used to form an array of drops derived from parallel jets; the method according to the invention is particularly suitable for stimulation of a piezoelectric actuator, the polarity of which is advantageously adapted to the polarity of the pulses.

According to another aspect, the invention relates to a device for generating an array of drops, particularly forming part of a print-head, adapted to the method according to the invention, comprising a plurality of spaced stimulation chambers, preferably supplied from a single reservoir, provided with ejection nozzles opposite piezoelectric actuators larger than the surface area of the stimulation chamber, for example to cover 10 to 20% of the walls separating the different chambers. The actuators are connected to means of generating a stimulation pulse.

BRIEF DESCRIPTION OF THE DRAWINGS

Other characteristics and advantages of the invention will become clearer after reading the following description with reference to the attached drawings, given as illustrations and that are in no way limitative.

DETAILED PRESENTATION OF PARTICULAR EMBODIMENTS

According to the invention, the drop generator is designed so that it can operate at very high stimulation intensities, through short pulses. Consequently, the different elements of the generator are such that deformation of the free surface of the jet at the exit from the nozzle is greater than 20% of the average diameter of the continuous jet, which is not possible through usual generators; in particular, the generator is of the piezoelectric type and the following discrete elements are designed to impose an effective deformation of the jet surface rather than a slight modulation: in particular geometry and dimension of walls supporting the piezoelectric element, restriction passage, ink volume confined in the chamber and nozzle diameter are purposely defined.

Figure 1A:
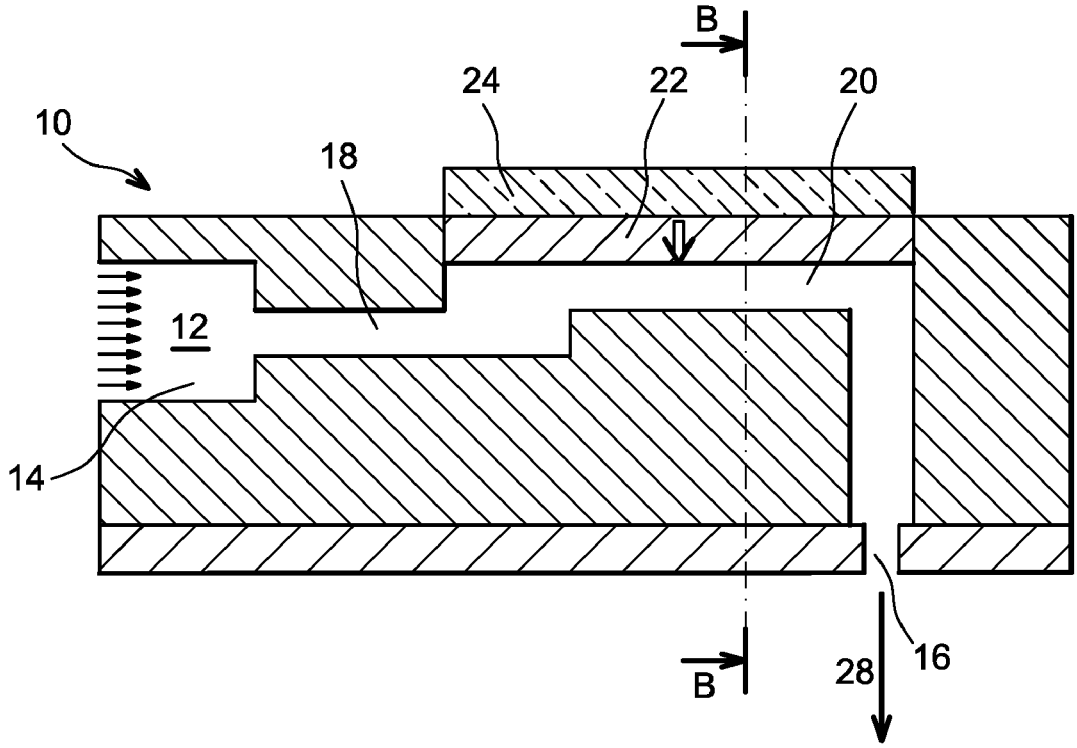
FIGS. 1A, 1B and 1C show a drop generator according to the invention.

A drop generator 10 that is particularly suitable for the invention is illustrated in FIG. 1. Pressurized ink 12 is supplied to a secondary reservoir 14 internal to the generator 10; the reservoir 14 distributes ink 12 to a network of nozzles 16, only one of which is shown on the section in FIG. 1A. Each nozzle 16 is supplied by an individual hydraulic path that comprises a sequence of channels; in particular, one of the channels 18 performs a restriction function, and a second channel 20 is a stimulation chamber, in other words a cavity filled with ink 12 in which one of the faces, for example a membrane 22, deforms under the action of a piezoelectric actuator 24.

The ink volume contained in the chamber 20 varies according to the action of the piezoelectric element 24 itself controlled by an electrical voltage: the effect of this action is to modulate the radius of the liquid jet emitted by the nozzle 16. Modulation of the radius of the jet controls fragmentation of the jet into droplets.

Figure 1B:
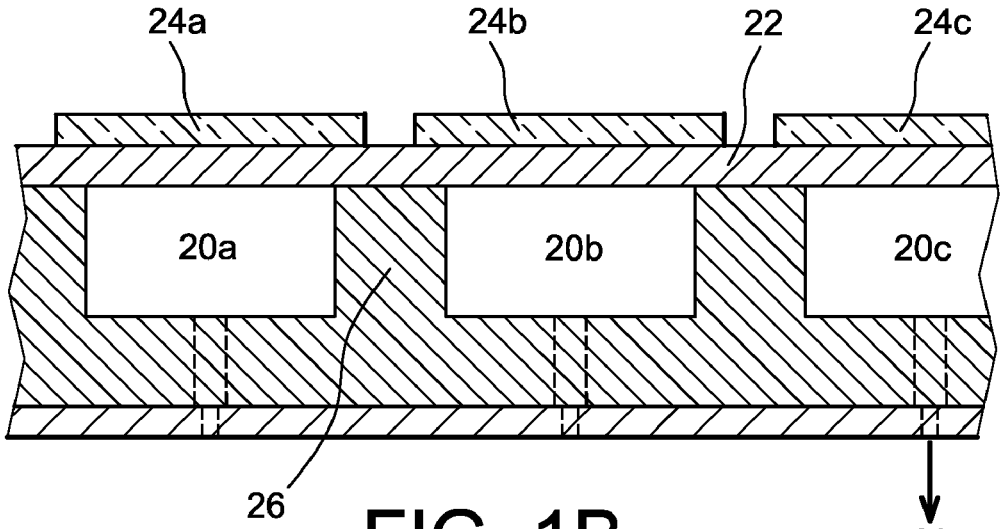
Figure 1C:
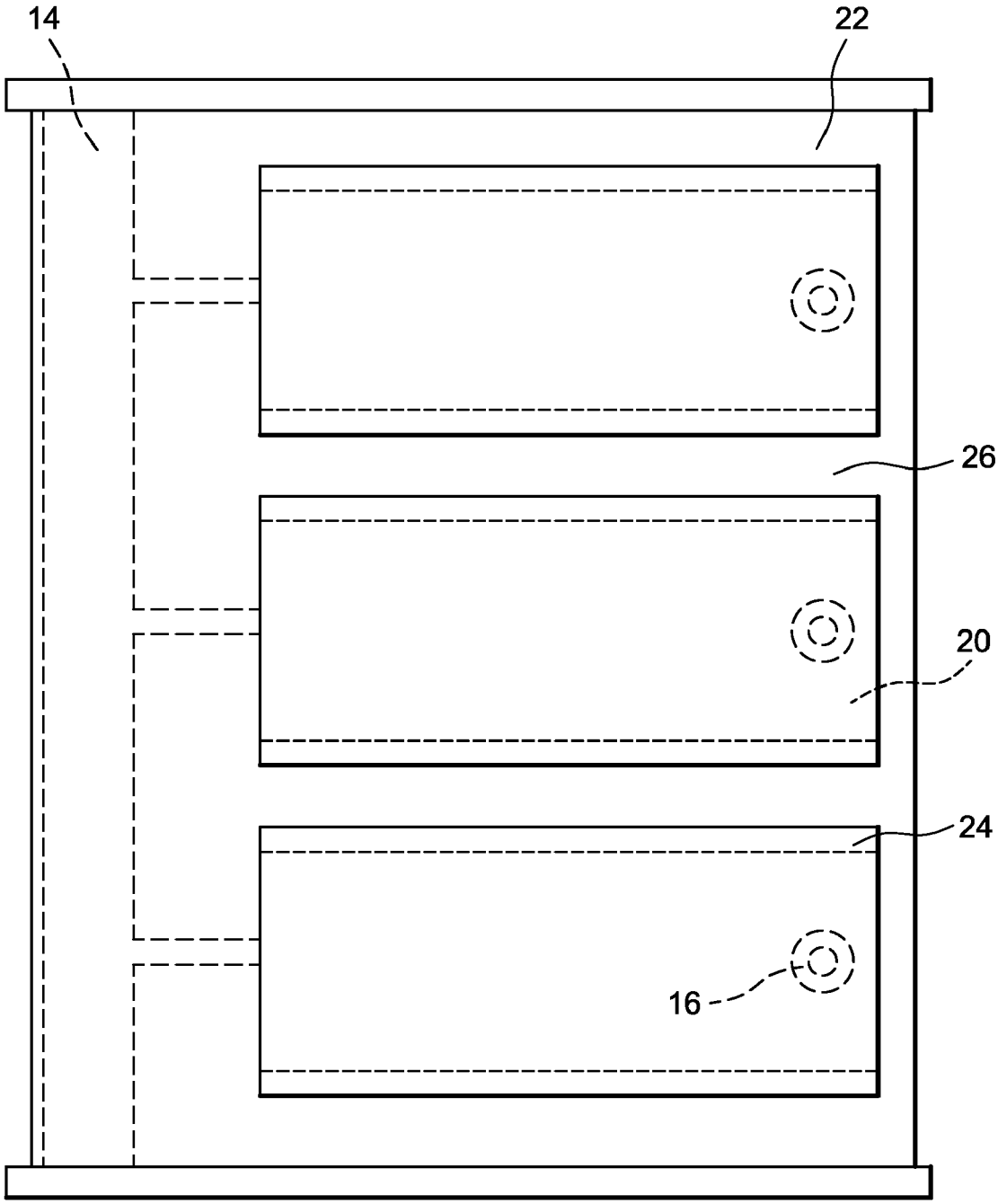

The generator is adapted to form a multitude of jets; FIG. 1B shows the sequence of chambers 20*a*, 20*b*, 20*c* associated with an array of nozzles 16. Preferably, each jet derived from the generator 10 may be controlled individually in a similar manner by a piezoelectric element 24*i* associated with each chamber 20*i*, possibly using a single membrane 22, or a plurality of membranes. For example, the chambers 20*i* are adjacent to each other and are separated by a separating wall 26 that prevents liquid from communicating between two adjacent chambers; see FIG. 1C.

If there is no stimulation, the ink 12 flows through each nozzle 16 forming a continuous cylindrical liquid jet 28 with an average diameter $2 \cdot R_{28}$ and mean velocity $V_{28}$. Each jet 28 is naturally unstable for wavelengths $\lambda$ longer than a limiting value; this instability criterion, determined by Lord W S Rayleigh (*Proceedings of the London Math. Soc.* 1879; X: 4-13), is respected if the oscillation wavelength $\lambda$ of the jet 28 is greater than or equal to the circumference of the jet ($\lambda \geqq 2 \cdot \pi \cdot R_{28}$).

Figure 2:
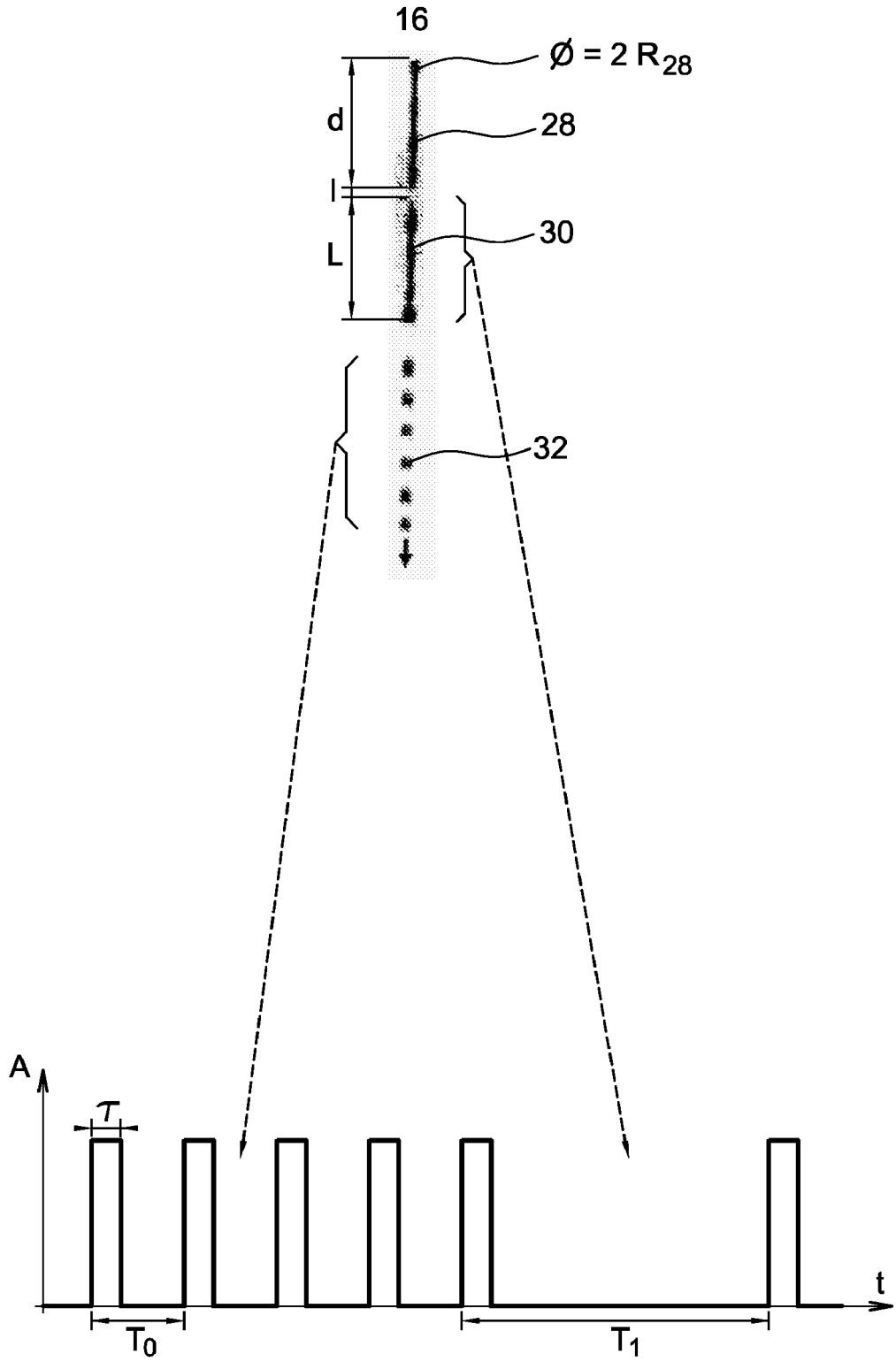
FIG. 2 illustrates the principle of generating drops according to the invention.

Each jet 28 is fragmented in a controlled manner into segments 30 that will form droplets 32 depending on the surface tension of the liquid, when an electrical signal called the stimulation signal is applied to the piezoelectric element 24, consequently modifying the pressure on the liquid 12 at the vicinity of the nozzle 16; thus, as shown in FIG. 2, each continuous jet 28 of liquid is interrupted on demand by a very short voltage pulse applied to the piezoelectric element 24. The pulse duration $\tau$ combined with the advance speed of the jet $V_{28}$ disturbs a portion of jet with length l ($l = V_{28} \cdot \tau$) very much shorter than the optimum wavelength $\lambda_{opt}$ for which the jet 28 is the most unstable; the optimum wavelength $\lambda_{opt}$ is close to $9 \cdot R_{28}$ (where $R_{28}$ is the average radius of the jet). In particular, it is chosen that $\tau << 4.5 \cdot R_{28}/V_{28}$, or even $\tau << 2 \cdot R_{28}/V_{28}$, or even $\tau \leqq R_{28}/V_{28}$; the break up length d represents the distance after which the stimulated portion of the jet 28 with length l (instability zone) causes the break up in the jet. Two successive breaks thus produce jet segments 30; the jet segments 30 are substantially cylindrical in shape as they are separated from the jet 28, the shape factor of the segments being such that their length L is greater than their diameter $2 \cdot R_{28}$ (in any case, the segments do not have the usual quasi-spherical shape as e.g. disclosed in document U.S. Pat. No. 4,346,387 (Herz), wherein the drop is separated from the jet when reaching its size, namely the diameter of the jet between two constrictions due to the frequency stimulation).

Preferably, the pulse produces a local restriction of the jet radius 28 by correctly combining the polarity of the electrical signal and the polarization direction of the actuator 24. The advantage of the applied restriction is to produce a unique break up of the jet 28 by thinning of the stimulated zone 1 of the jet. Due to the stimulation level, the surface tension acts quickly which minimizes the influence of other properties of the ink 12 over the unstable length l, so as to form segments 30 and drops 32 issued from jets 28 based on solvents 12 with very different physical properties, such as water, alcohol, acetone, etc. based liquids, at the same distance d from the nozzle 16; thus the changes of settings of the print head if the ink is changed are correspondingly reduced.

As an example application, the square pulse duration for a jet with diameter $2 \cdot R_{28}$=35 μm and moving at an average velocity $V_{28}$=10 m/s will be τ=2 μs. The length of the stimulated jet portion will be l=20 μm (compared with the optimum wavelength of 160 μm).

Preferably according to the invention, the stimulation signal only includes two voltage levels, namely the reference level 0 and the amplitude A of the signal with duration τ: the signal is of the type "fixed amplitude frequency modulation". The stimulation signal is composed of a sequence of pulses, particularly square pulses at a time interval T, knowing that τ<<T. This period T combined with the advance speed of the jet $V_{28}$ delimits a jet segment 30 with length $L=V_{28} \cdot T$, which determines the size of the drops 32 subsequently formed by the segment 30. Preferably, the length L of the segment 30 is greater than the optimum wavelength $\lambda_{opt}$.

The actuator 24 inducing the disturbance on the jet is inherently piezoelectric; it uses low voltage electrical control means, typically less than 30 V. Furthermore, due to the actuation mode according to the invention, each pulse duration τ produces a forced break up of the jet 28, the break up location being unique or almost unique, at a distance d from the nozzle plate 16 regardless of the size of the drops 32 considered; this is a very strong stimulation rate that creates a short break up distance d; in particular $d \leqq 5 \cdot \lambda_{opt}$. Furthermore, the stimulation efficiency is such that the actuator 24 deforms the jet by more than 20% of the jet diameter $2 \cdot R_{28}$ at the ejection nozzle 16; therefore, the deformation of the free surface of the jet 28 is clearly visible at the exit from the nozzle 16.

Combined with the previous conditions, the stimulation pulse signal breaks up the continuous jet 28 at specific points without producing any parasite satellites or ink droplets. By repeating this stimulation mode, the pulse τ breaks up the continuous jet 28 on demand into cylindrical segments 30 for which the length L depends only on the time interval T separating two successive pulses τ; the duration T may vary from one pulse to another on request, thus generating variable length segments 30.

Furthermore, to minimize interference due to mechanical causes between adjacent or nearby jets (for example jets originating from two contiguous chambers 20*a*, 20*b*), it is very advantageous to produce a sequence of drops 32 using a series of pulses rather than an analog signal with frequency 1/T. Under pulse conditions, the damping coefficient and the stiffness of materials tend to increase with the frequency. For a multijet device 10, the stimulation conditions according to the invention thus provide excellent robustness against mechanical and vibration crosstalk. Consequently, the break location induced by interference (breaking up of jets 28 for which the actuator 24 is at rest but the adjacent actuator 24*i* is active) is at a distance equal to at least 25 optimum wavelengths $\lambda_{opt}$ from the nozzle plate (ejection orifice 16); since the nominal break up distance for operation d is very short, of the order of 5 optimum wavelengths $\lambda_{opt}$, these interference phenomena are very weak and have no significant effect on operation of the method.

In order to further reduce and to balance the interference ratio between jets, the width of the actuator elements 24*i* is slightly greater than the width of the corresponding chamber 20*i* so as to bear on the sidewalls 26 separating them, and thus facilitate operation of the actuator 24 in bending. It is also preferable to avoid having the width of the piezoelectric actuator 24*i* exactly the same as the width of the chamber 20*i* since a slight lateral offset of the chamber 20 from the actuator 24 significantly modifies the interference ratio. The best homogeneity of the interference ratio is obtained by making the actuator 24 slightly overlap the walls 26 that separate the chambers 20, for example by a distance of the order of 10 to 20% of the width of the separating wall 26, and particularly 15% of this width.

With the generator according to the invention, the interference rate is minimized such that when multijets are used, action on one jet has very little influence on adjacent jets; therefore the jet control electronics is simplified since the control signal does not need to be corrected as a function of the ejection configuration of neighbouring jets.

The disclosed generator is adapted to form an array of jets 28, typically 100 jets located in the same plane, at a pitch of 250 μm. The jets with a velocity 10 m/s derive from pressurized liquid 12 flowing from nozzles 16 with a diameter of 35 μm. Each stream 28 is controlled by an independent piezoelectric actuator 24 to be broken up into segments 30 with a predefined length.

The following advantages are obtained by the generator according to the invention, while overcoming the disadvantages mentioned according to prior art:

- It is possible to break up a continuous jet 28 into segments 30 with a length L adjustable on demand, at high frequency, the segments 30 being substantially cylindrical with $L>2 \cdot R_{28}$. The size of the droplets 32 produced resulting from contraction of the segment 30 can thus vary within a very wide range and very accurately, depending on the length L of the segment 30. The advantages of this are:
  - when printing, since the size of the impacts of drops 32 is variable, the grey levels or the visual appearance of different levels of brightness are improved;
  - according to one variant, the volume of the drop 32 can be adapted to maintain a constant impact diameter on substrates with very different natures, such as absorbent, non-absorbent or fibrous media, etc.
- Control of the piezoelectric actuator 24 by very low energy and short duration electrical pulses τ produces very little heat, which prevents denaturing of the quality of the ink 12.
- Permanent circulation of the liquid 12 in the drop generator 10 stabilizes the operating temperature by efficiently dissipating the small amount of heat energy that might be produced by the actuator 24, which improves the reliability and reproducibility of the drop generator 10.
- The coupling level between adjacent actuators 24*i* is low, such that for a multijet device 10, breakage of a jet 28 is independent of the context of adjacent jets. Unlike the drop-on-demand technology, interference does not disturb drop ejection and formation conditions such that operation of the drop generator 10 is simple and robust.
- The stimulation efficiency results in a very short break up length d of the jet 28, which firstly reduces jet/drop directivity constraints, and secondly minimizes the influence of properties of the ink 12.
- Unlike existing technologies, the conventional capillary instability phenomenon is not used; operation of the drop generator 10 tolerates inks 12 with a wide variety of physicochemical properties, and particularly high viscosity ink jets that can be efficiently broken up.

The invention claimed is:

1. Method for projecting a liquid in the form of drops from a generator comprising:

pressurizing the liquid in a chamber provided with at least one exit nozzle such that at least one jet, with an average radius exits from the chamber at a certain velocity through a nozzle;

disturbing the jet by a stimulation pulse such that the jet is broken up at a jet break up location, the pulse duration being less than four and a half times the ratio of the jet radius to velocity, wherein the stimulation efficiency being such that the jet is deformed with an amplitude of the diameter deformation of the jet which is greater than 20% of the average jet diameter of the continuous liquid jet, at a distance from the nozzle, wherein the distance is less than or equal to five times an optimum jet instability wavelength, the optimum jet instability wavelength which is the oscillation wavelength of the jet for which the jet is the most unstable.

2. Method according to claim 1 comprising disturbance of the jet by a plurality of successive stimulation pulses, at a spacing equal to a time period.

3. Method according to claim 2 wherein a length of a jet segment produced by two successive breaks of the jet and created during the time period is greater than the optimum jet instability wavelength.

4. Method according to claim 2 wherein the time period separating each pulse varies so as to create drops with different diameters.

5. Method according to claim 1 wherein each pulse has a constant amplitude.

6. Method according to claim 1 wherein the jet is disturbed by activating piezoelectric means installed at the chamber.

7. Method according to claim 6 wherein the polarity of the stimulation pulses is combined with the polarisation direction of the piezoelectric means such that the disturbance on the jet is a local restriction of the jet.

8. Method for generating drops from an array of jets comprising independent simultaneous projection of drops for each jet according to the method of claim 1.

9. Ink jet printing method comprising generation of drops according claim 1.

10. Device generating an array of liquid drops comprising a plurality of adjacent chambers containing pressurised liquid and separated from each other by a wall, each chamber supplying an ejection nozzle with liquid to form a continuous jet of liquid, each chamber comprising a wall opposite the nozzle that supports a piezoelectric actuator to disturb the jet and thus generating jet segments with adjustable length, and means for generating a low voltage pulse connected to each actuator wherein the surface of each piezoelectric actuator being such that each actuator overlaps at least part of each separating wall of the chamber.

11. Device according to claim 10 wherein the actuator overlaps 10 to 20% of the thickness of each separating wall.

12. Device according to claim 10, also comprising a single ink tank supplying the plurality of chambers.

13. Ink jet print head comprising a device according to claim 10.

* * * * *